US005255539A

United States Patent [19]

Zimmer

[11] Patent Number: 5,255,539

[45] Date of Patent: Oct. 26, 1993

[54] APPARATUS FOR TREATING A WEB

[76] Inventor: Johannes Zimmer, Ebentaler Strasse 133, A-9020 Klagenfurt, Austria

[21] Appl. No.: 949,696

[22] Filed: Sep. 23, 1992

[30] Foreign Application Priority Data

Sep. 23, 1991 [AT] Austria ..... 1913/91

[51] Int. Cl.[5] ..... D06B 1/14

[52] U.S. Cl. ..... 68/43; 68/202; 118/249

[58] Field of Search ..... 68/205 R, 202, 43; 8/151; 101/116; 100/73; 118/206, 247

[56] References Cited

U.S. PATENT DOCUMENTS 2,572,268 10/1951 Kuljian ..... 68/202
2,627,480 2/1953 Heizer ..... 68/202 X
2,781,655 2/1957 Brown ..... 68/43
3,421,164 1/1969 Zuczef ..... 68/43
3,495,285 2/1970 Zimmer ..... 68/202 X
4,532,782 8/1985 Sellers ..... 68/43 X

OTHER PUBLICATIONS

PCT/AT86/00052 Mar. 1987.

*Primary Examiner*—Frankie L. Stinson
*Attorney, Agent, or Firm*—Herbert Dubno

[57] ABSTRACT

A web passing around a drum or other countersurface is engaged by a working roll which is bendable along its length to conform to the countersurface and thereby provide uniform contact with the web. The working roller is supplied by one or more force transmitting elements which are also bendable in their lengths and which can include a bed in which the force transmitting roll is received. The bed is urged by hydraulic pistons or a liquid expandable tube, braced against a nonbendable support, in the direction of the working roll.

19 Claims, 5 Drawing Sheets

APPARATUS FOR TREATING A WEB

CROSS REFERENCE TO RELATED APPLICATIONS

This application is related to my copending applications Ser. Nos. 07/847,029 filed 13 Apr. 1992; 07/765,658 filed 25 Sep. 1991; 07/761,882 filed 16 Sep. 1991; 07/727,622 filed 10 Jul. 1991; 07/659,285 filed 11 Apr. 1991; 07/635,123 filed 5 Mar. 1991; 07/635,115 filed 13 Feb. 1991; 07/919,077 filed 23 Jul. 1992. Reference may also be had to U.S. Pat. Nos. 5,148,743; 5,151,132 and 4,892,057.

FIELD OF THE INVENTION

My present invention relates to an apparatus for treating a web and, more particularly, to an apparatus for the application of a liquid substance to a web or the removal of excess flowable substance from a web by a squeegee action, for pressing a flowable substance into a web, or for other treatments involving the application of a working roll to a web supported by a countersurface supported by a beam, counterroller or drum.

BACKGROUND OF THE INVENTION

In the treatment of webs of fabric or the like, where a liquid is applied to or removed from the web (see the aforementioned copending applications and the concurrently filed copending application Ser. No. 949,697, it is important that the treatment be uniform over the entire width of the web.

This can only be achieved when the pressure with which the working roll and the counterroller are pressed together is substantially constant and uniform over the entire machine width, corresponding to the width of the web.

A problem which always appears to arise in this connection is the bending of the rollers as a consequence of the relatively high working width (and roller length). This bending is greater as the diameter of a roller or drum is smaller, the wall thickness of the roller or drum is less and the length of the roller or drum is greater.

In order to simplify maintenance, repair and other handling of the rollers, it is advantageous to make them relatively light and of smaller diameter. This, of course, increases the problem of bending.

There are a number of approaches to solve this problem. For example, it is known to provide rollers which are pressurized internally by hydromechanical means and thus are intentionally deformed to overcome the bend effect These systems are complex to fabricate and expensive to maintain and require the delivery of a hydromechanical medium to the interior of the roller, so that for this purpose alone it must have a relatively larger diameter the. The axial journaling of such rollers is also expensive and complicated and roller replacement is costly.

In practice, the problem of bending is attacked by making the rollers of rubber and grinding them so that they have a bulging shape. However, such rollers shaped to overcome the effect of bending can only be used effectively at a single press pressure and thus provide uniform results only for a single web width. It is, therefore, necessary to frequently change the rollers for the desired pressure and web width. This means frequent standstill of the machine which is not economical.

OBJECTS OF THE INVENTION

It is, therefore, the principal object of the present invention to provide an apparatus capable of uniformly pressing a web between a working roll and countersurface whereby the aforementioned drawbacks are avoided.

Another object is to provide an apparatus for effecting uniform treatment of webs of different widths and with different work pressures and wherein the working rolls are easy to handle and easily replaceable.

Still another object of the invention is to increase the versatility of a machine for the treatment of a fabric web so that the treatment device can be used for example at squeezing the web at a high pressing force or for the application of liquid material or flowable substances to the web with low pressing with no material downtime.

It is still another object of this invention to provide an apparatus which can accommodate the working width to the width of the web and enable various pressing forces to be provided over the working width.

SUMMARY OF THE INVENTION

These objects are achieved by providing the counterroller or drum or the counterbeam forming the countersurface at a distance from and parallel to a transverse beam, support body, girder, or the like forming the fixed support in which the force generating elements are provided and, in the space between the counterroller or counterbeam and the transverse beam or support girder, an assembly of a working roll which is bendable to conform to the contour of the countersurface and a bendable element transmitting force to the working roll, e.g. a slide bearing beam, journaling bed, cylindrical body, support roller, pressing plate, reinforcing plate or the like so that this assembly can accommodate by bending to the contours of the bending drum under the pressing force produced by the pressing force generator.

More particularly, the apparatus of the invention can comprise:

means forming a countersurface along which the web is guided, the countersurface extending across a width of the web;

an elongated stiff support element spaced from the countersurface, extending over the width and being substantially nonbendable over a length of the support element;

a pressing-force generator on the support element and braced thereby for applying a pressing force generally in a direction of the countersurface; and a bendable assembly interposed between the web and the pressing-force generator and adapted to bend upon the application of the pressing force thereto across the width to conform to the countersurface, the assembly comprising:

a working roll free from axial journals and floating relative to the countersurface juxtaposed with the countersurface and bearing upon the web, and at least one force transmitting member bearing upon the working roll and acted upon by the pressing force generator, extending over a length of the working roll and supporting same while transmitting the pressing force to the working roll, both the working roll and the force transmitting member being bendable over the width.

According to a feature of the invention, the counterroll has a substantially larger diameter than the working roll an the working roll is composed of a bendable material. The relatively smaller diameter of the working roll has the advantage that relatively high working forces can be applied per unit working area because the contact zone is relatively small. If liquid is to be squeezed out of a textile web, for example, the liquid can flow more readily because the squeezing roll is relatively smaller.

The higher pressing effectiveness means that higher speeds can be provided and thus the energy required for subsequent drying can be reduced.

Such working rolls can be easily fabricated and because of their smaller diameter and freedom from axial bearings easily handled and replaced. The place required for such rolls can be smaller and the apparatus more compact so that it can be accommodated in retrofitted plants and lines. In addition, because of the small size, a number of working rolls can be provided around the same drum to operate in succession on the same web.

The pressing force can be varied by control of the force generating devices over a wide pressure range. If the pressing force generating elements are pneumatic pistons then these pistons can be spaced across the width of the machine and local control of the pressing force be varied by varying the air pressure. This has been found to be advantageous in many cases.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
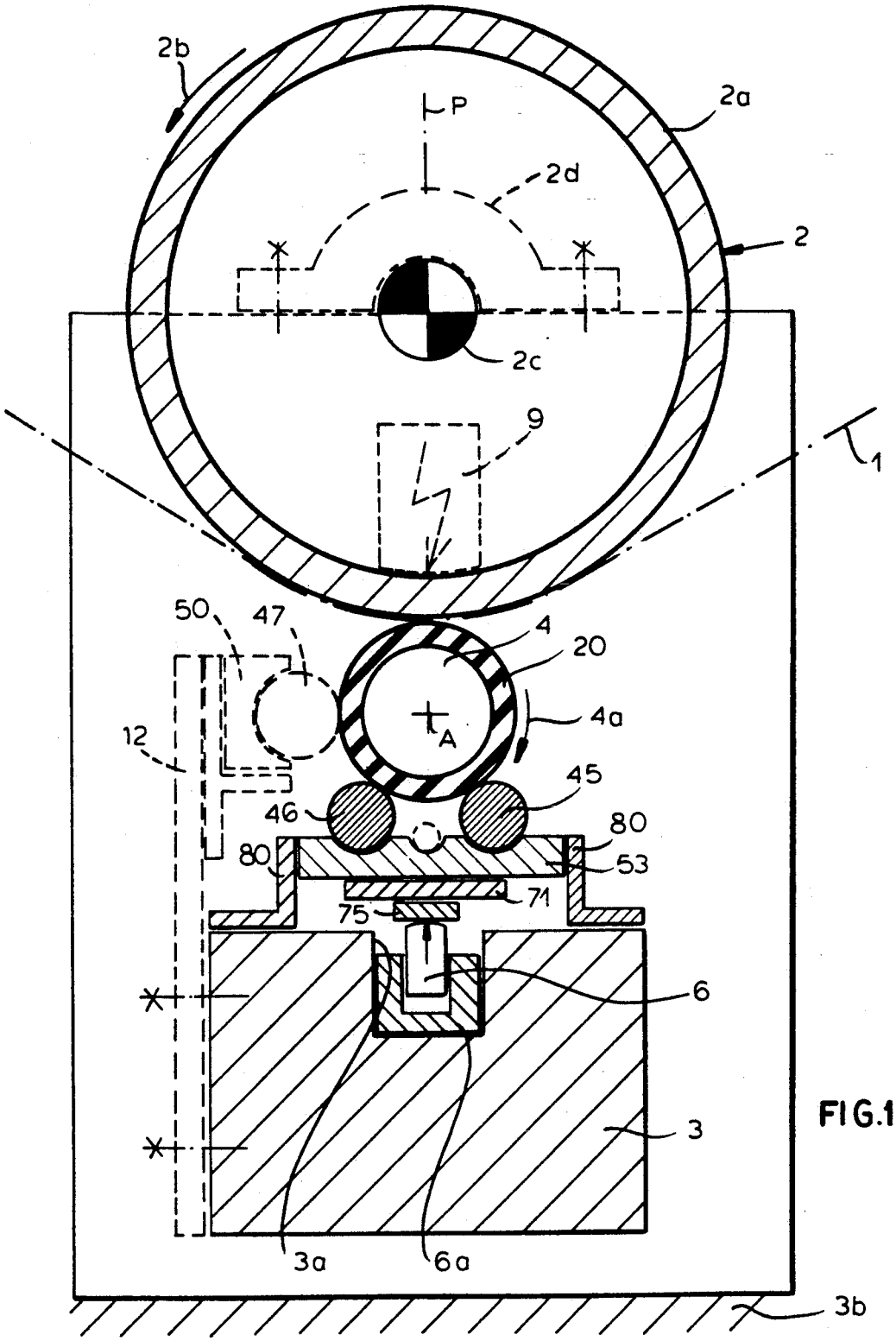
FIG. 1 is a cross sectional view taken in a vertical plane transverse to the machine width and in the direction of travel of a web, illustrating highly diagrammatically an apparatus according to the invention having a working roll supported by two cylindrical pressing bodies or rollers carried by a common beam or bed urged against the working roll and pressing the working roll toward the countersurface, here formed by a counterroll or drum.

From FIG. 1 it will be apparent that a web 1 can be guided against a countersurface 2*a* formed by a drum 2 which can be rotated in the counterclockwise sense (arrow 2*b*) by entrainment with the web 1 or by an appropriate drive which can entrain the web 1, or by frictional entrainment with a working roll 4 if the latter is driven. In any event, the working roll 4 is also rotatable in the sense of arrow 4*a*, either by frictional entrainment or being driven.

The drum 2 can have a shaft 2*c* which is fixedly journaled in, for example, journal blocks 2*d* only one of which has been illustrated. These journal blocks are provided on a machine support 3*a* which forms part of the machine frame or chassis fixed to a foundation or base 3*b* to provide a fully stable and immobile support structure.

This support structure comprises a beam 3 which extends between the uprights 3*a* of the machine frame and is also fixed, highly stable and substantially unbendable.

The working roll 4 has a substantially smaller diameter than the drum or counterroller 2 and is bendable over its length to equalize the pressure applied to the web 1 and the counterroller 2 over the entire width of the machine perpendicular to the plane of the paper.

The working roller 4 is provided with a jacket 20 which is yieldable (compressable) and either smooth or structured and can be bibulous or otherwise constructed so that it can carry a flowable substance onto the web 1 or remove a flowable substance from the web. The jacket thus can pick up, transport and release a flowable substance with which the web is to be treated.

The pressing of the working roll 4, which is axially unsupported, i.e. floats in a cradle without bearings for a shaft or other bearings at the axial ends of the roll 4, by a pair of likewise bendable cylindrical bodies or pressing rollers 45, 46 which are also bearing-free at the respective axes. The pressing rollers 45 and 46 form the cradle for the working roll 4 and are themselves supported in a common bendable slide bearing bed 53. The bendability in each case is bendability in a plane P perpendicular to the plane of the paper and through the axis of the respective roller, e.g. through the axis A for the working roll 4 in FIG. 1 or in planes parallel thereto and perpendicular to the plane of the bed 53. The bendability of the bed 53 is also in the plane P and in each case the bendability is such that the body or roller or bed can conform to the bending of the bendable element against which the same lies.

Beneath the bed 53 is a pressing plate 71 and a reinforcing or stiffening plate 75 against which a piston arrangement 6 bears to apply the pressing force.

The piston 6 shown in FIG. 1 may represent a single bar extending the full machine width or a plurality of cylindrical pistons arrayed perpendicular to the plane of the paper in FIG. 1 and spaced apart in the direction of the machine width. The cylinders or cylinder structure is represented at 6*a* and can be supplied with hydraulic fluid to develop the pressing force and the cylinder 6*a* is received in the fixed beam 3 which, for that purpose can have an upwardly open recess 3*a*.

Carried by the beam 3 are two angle bars 80 which flank the bed 53 and serve as a guide for this bed preventing lateral shifting thereof.

A plate 12 is bolted to the bean 3 and carries a bracket 12*a* on which a further slide bearing bed 50 can be mounted for a support roller 47 which laterally engages the working roll 4. The assembly 12, 12*a*, 50, 47 is optional as indicated by the broken line showing thereof.

Advantageously, the elements which distribute the pressing force and are in the train between the generation of the pressing force and the web 1 and surface 2*a* (working roll 4, cylindrical pressing bodies or rollers 45, 46, bed 53, plate 71 and reinforcing plate 75) beginning from the reinforcing plate 75 and running through the working roller 4 are all bendable in the sense mentioned and can conform to the bending of the previous element or the following element. As a consequence the individual elements are freely positionable against one another and provide an especially uniform pressure distribution and force transfer over the working width of the machine from the working roll 4 to the counterroller 2.

As illustrated by the original electromagnet 9 within the drum 2, in addition to the pressing force contributed by the pistons can be brought about magnetically by attraction of the working roll 4 or any of the parts bearing thereon composed at least partially of magnetic material.

Figure 2:
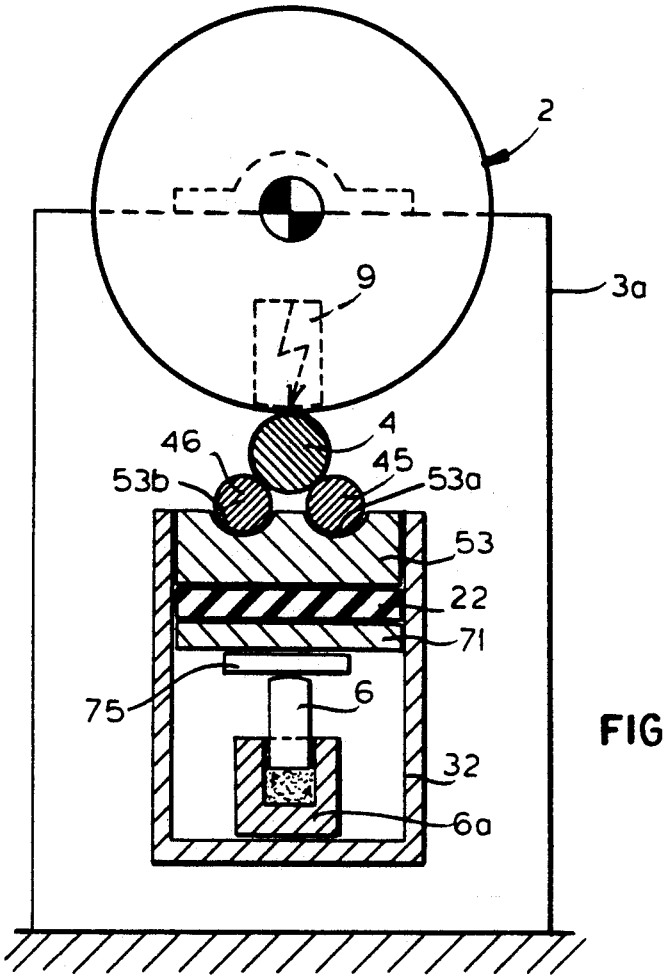
FIG. 2 is a diagrammatic section similar to FIG. 1 in which the rigid beam is shown to have a different configuration.

FIG. 2 shows an embodiment of the invention where the working roll 4 is cradled between two cylindrical supporting and pressing bodies or rollers 45, 46, each of which is received in a respective recess 53*a*, 53*b* of the slide bearing bed 53. In the present application, reference to a "bed" will be intended to refer to a bar, beam, or similar structure extending the full machine width and provided with such a recess in which the body or roller is slidingly rotatable. An antifriction material can be provided in this recess to reduce the sliding friction between the roller in the recess and the bed surface bearing thereagainst.

Between the bed 53 and the plate 71 there is here provided a deformable cushion 22, e.g. of rubber, promoting uniform pressure distribution between the force generating means 6 and the bed 53.

All elements between the force generating means 6 and the counterroller or drum 2 are bendable in accordance with the principles outlined previously and are received in a U-shaped girder 32 extending the full machine width and forcing the support body which takes up the reaction force of the cylinder or cylinders 6*a*. The girder 32 is the equivalent of the beam 3 previously mentioned and is anchored to the loading plates 3*a* etc. of the machine support. The girder 32 also provides lateral guidance of the assembly formed by the bed 53, the cushion 22 and the plate 71.

Figure 3:
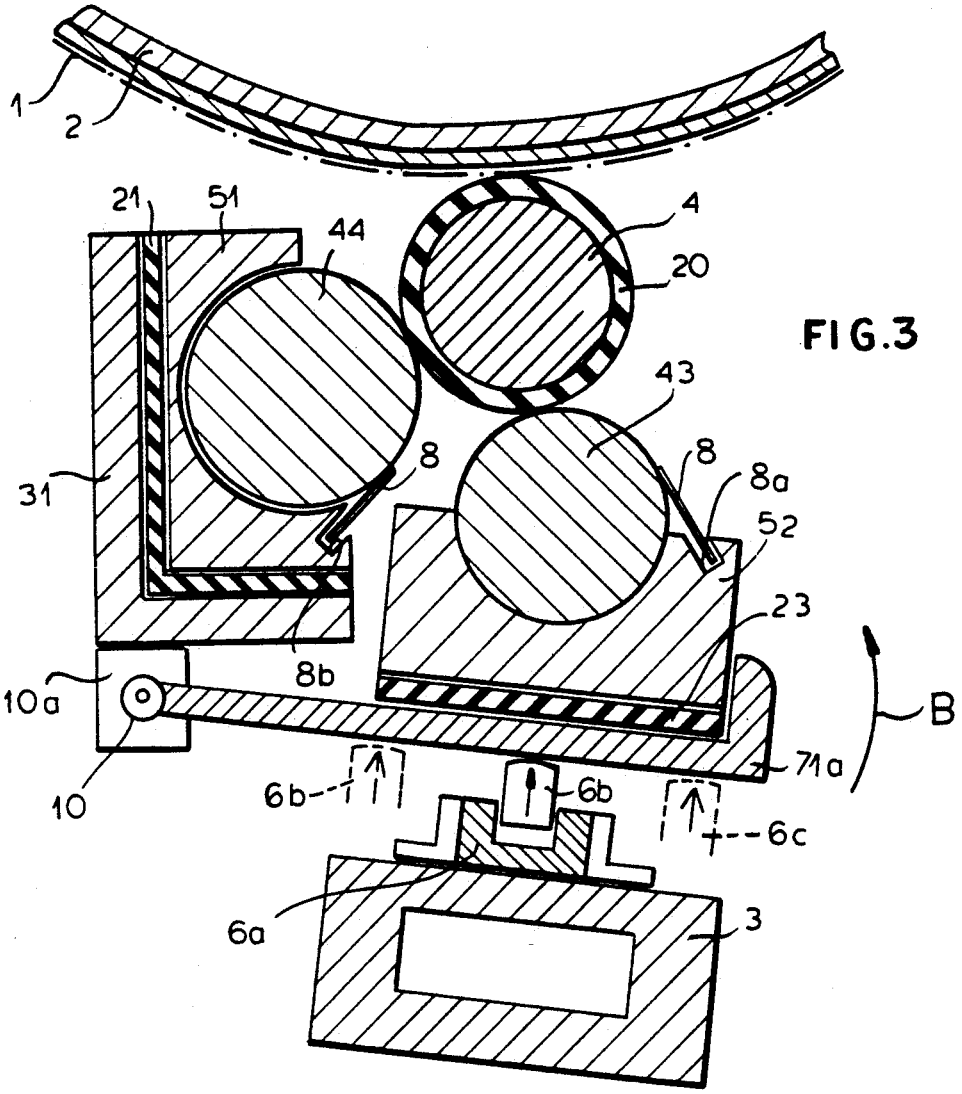
FIG. 3 is a section similar to that of FIG. 1 in which two different cylindrical pressing bodies or rollers are provided in separate beds, one of which is fixed, while the other is movable.

As in the embodiments of FIGS. 1 and 2, the embodiment of FIG. 3 has a working roll 4 which is not supported in bearings at its axial ends and can rest in a cradle, here formed by the cylindrical bodies or rollers 43 and 44. The working roll 4 is also provided here with a yieldable jacket 20 of rubber, nonwoven fabric, fleece, felt or the like. The working roll 4 bears against the web 1 which is supported on the counterroller or drum 2. The jacket 20 can be smooth or structured and is compressible and capable of taking up, transporting and releasing liquid or other flowable substances.

In this embodiment, however, the cylindrical bodies or rollers 43, 44 are disposed in respective slide bearing beds 51, 52 and cooperate with doctor blades, scrapers or the like represented at. 8 and received in respective recesses 8*a* and 8*b* of the bed.

The bed 51 is fixed to a transverse support bean 31 fixed on the machine housing and between this beam 31 and bed 51, an elastic cushion 21 is provided.

The bed 52, however, also with interposition of an elastic cushion 23, is mountable on a swingable plate 71*a* having a pivot or hinge 10 along one edge, communicated to supports 10*a* of the machine. Pistons 6*b* can be provided in respective cylinders 6*a* on the transverse beam 3 to displace the plate 71*a* as represented by the arrow B to drive the working roll 4 against the drum 2. Additional pistons may be provided at 6*c* and 6*d* if desired.

Thus the pistons 6*b* to 6*d* generate the force with which working roll 4 is pressed against the drum via pressing roller 43.

The support body or roller 44 serves as a counterpressure body. The pivot or hinge 10 is so constructed that the plate 71*a* cannot be lifted at its left hand side and thus functions as a fulcrum for the plate 71*a* which constitutes a lever. The lever can multiply the pressing force when the pistons 6*c* are used, it can be neutral with respect to the pressing force when the pistons 6*b* are used and can reduce the pressing force when the pistons 6*d* are employed.

Figure 4:
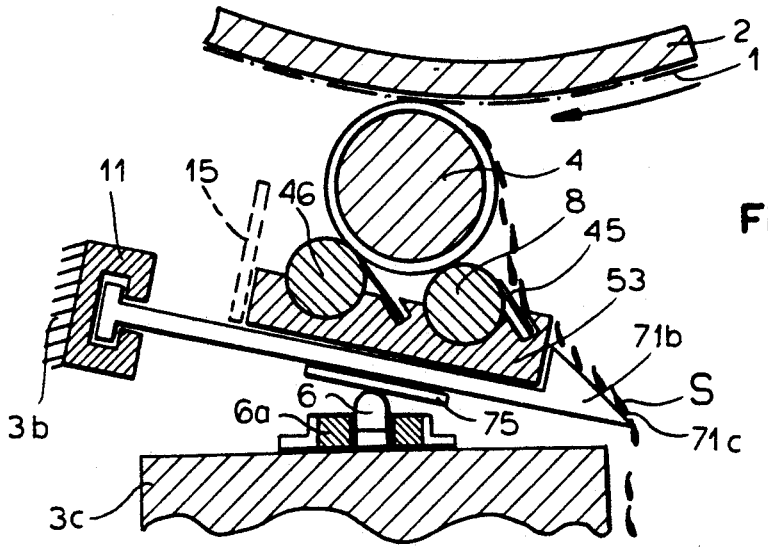
FIG. 4 is a fragmentary section also similar to that of FIG. 1 in which the movement of the bed for the two pressing rollers or bodies is not in translation but rather is effected by tilting.

FIG. 4 shows another advantageous embodiment of the invention wherein the cylindrical pressing bodies or rollers 45, 46 are here received in a common slide bearing bed 53 as in the embodiment of FIG. 1 and 2. The bearing bed 53 rests on a plate 71 (71*b*) which, at its left hand side, is accommodated in a roller 11 capable of taking up force from the plate and transferring that force to the housing 3*b* of the machine, while permitting some mobility of the left hand edge of plate 71*b*.

The plate 71*b* thus bas a lever action and can receive the pressing force from the lifting pistons 6 via the plate 75. A respective plate 75 may be located at each bearing point of a piston 6 upon the plate 71*b*. The plate 71*b* is inclined to the horizontal as shown in FIG. 4.

In the embodiment illustrated, the rollers 45 and 46 which cooperate with respective wipers or scrapers 8 and cradle the working roll 4 while applying the pressing force thereto. The rollers 45 and 46 with their respective wipers serve to remove excess flowable substance from the working roll 4 and as FIG. 4 illustrates, when the working roll 4 is pressed against the web 1 it can squeeze a liquid substance S from the web, the liquid flowing down over the roller 45 and its wiper 8 and along a drip edge 71*c* of plate 71*b* into a reservoir below the bean 3*c* on which the cylinders 6*a* are supported.

If desired, a strip 15 can also be provided on the plate 71*b* to provide a lateral guide for the bed 53 and a dam preventing any flowable substance on the bed 53 from passing beyond this strip. This arrangement is particularly compact and has been found to be especially convenient since the one piece bed, upon removal of the strip 15 is readily available for replacement and cleaning, particularly since the flowable substance is retained in a limited portion of the device and conducted sufficiently away from the latter.

Figure 5:
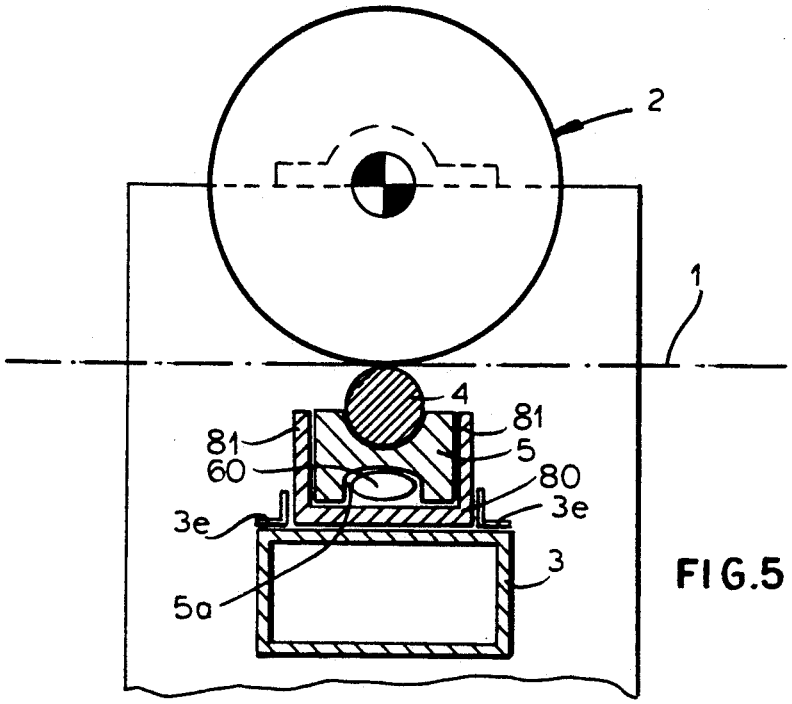
FIGS. 5 and 6 are sections showing embodiments in which the working roll itself is provided in a bearing or journaling bed beneath which the pressing force generating elements are provided, these devices being illustrated in a simplified form.

FIG. 5 represents a simplified device according to the invention in which the number of bendable elements is reduced to two, namely the working roller 4 and the bed 5 against which this working roll 4 is received. The pressing force is here generated by an expandable tube 60 supplied by a hydraulic fluid or air under pressure.

The tube 60 is received in a recess 5a of the bed 5 and is braced against the floor of a channel 80 whose cheeks 81 laterally guide the bed 5. The channel 80 is, in turn, received between angles 3e on the beam 3.

The bendable working roll 4 is received in the bed 5 which is pressed against the counterroller 2 and the web 1 upon liquid expansion of the tube 6. As is clearly visible from this embodiment the working roll 4 has a significantly reduced diameter by comparison with that of the counterroller 2.

Figure 6:
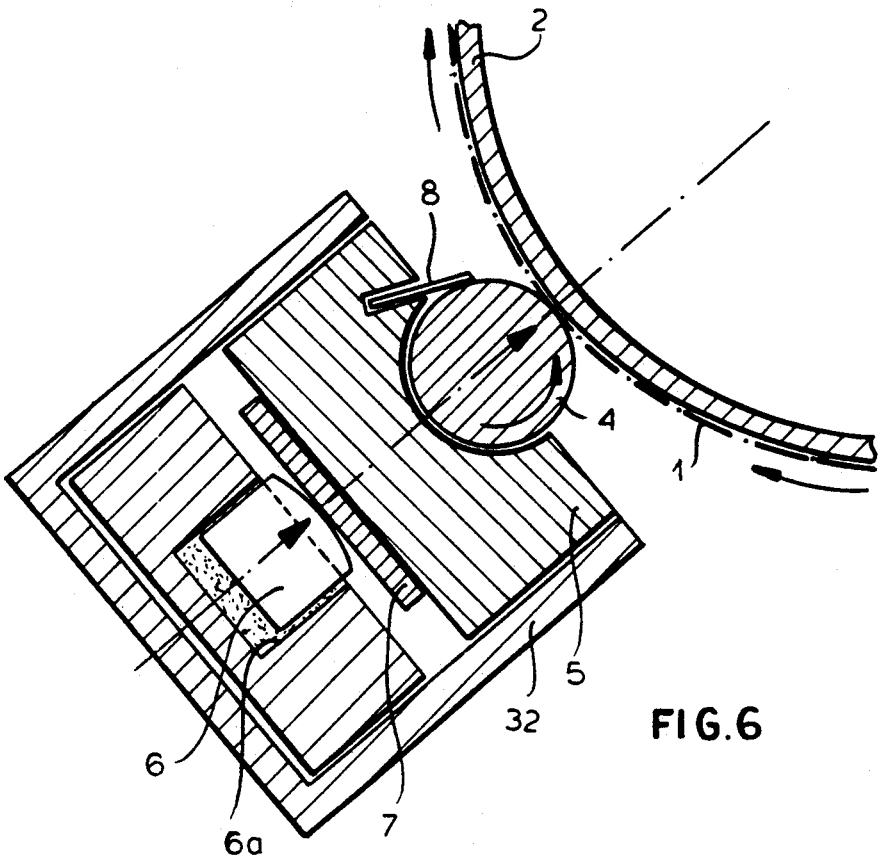

Turning to FIG. 6, it can be seen that a similarly simple embodiment is here provided. In the U-section support girder 32, an array of pistons 6 in respective cylinders 6a spaced apart in the direction of the machine width, can act on respective reinforcing plates 7 to urge the bendable bearing bed 5 toward the counterroller or drum 2 toward the web 1.

Figure 7:
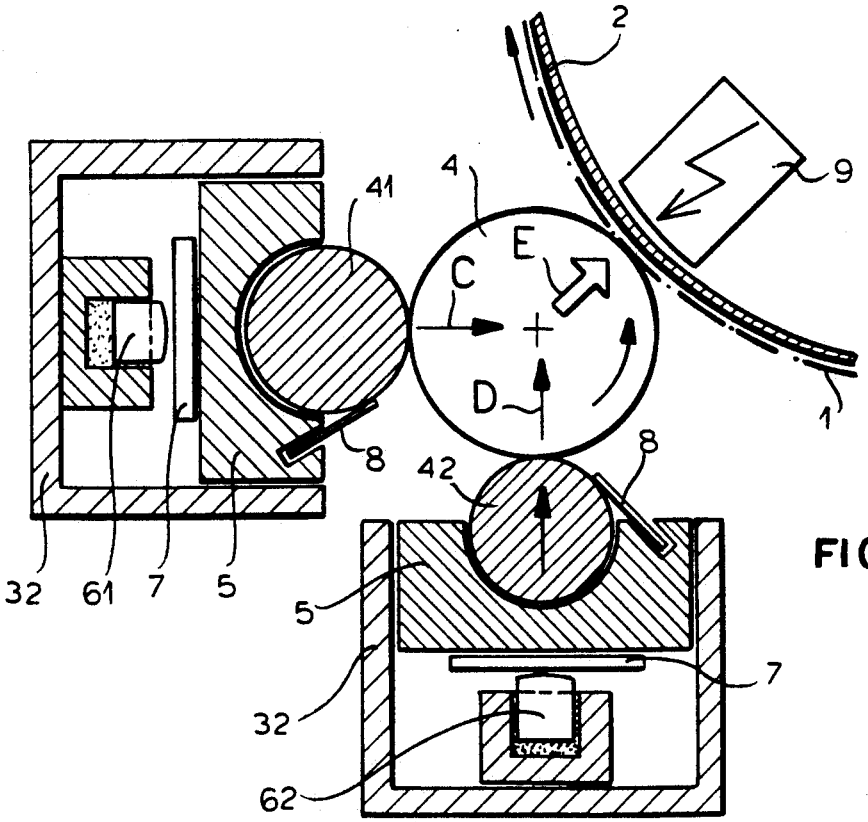
FIG. 7 is a section through another embodiment of the apparatus in which a plurality of cylindrical bodies or rollers are rotatable in respective bearing beds and can be biased by arrays of pistons toward the countersurface.

Here also the working roll 4 has a substantially smaller diameter than the counterroller 2. The bed 5 receives the working roll 4 which is also bendable and thus, when the pressing force is supplied, the bendable elements 5 and 4 can conform to the contour of the counterroller 2 along the line of contact of the roll 4 with the roller 2. In the direction of travel of the counterroller 2 downstream of the contact line, a wiper or scraper 8 bears against the working roll 4 to scrape contaminants therefrom. In the embodiment of FIG. 7 two U-section transverse beams or support bodies 32 are provided as stationary or fixed elements of the machine frame and each provided with a respective array of pistons 61, 62 received in respective cylinders spaced apart perpendicular to the plane of the paper and along the working roll 4.

Each of the pistons 61, 62 bears upon a respective plate 7 which, in turn, transmits force to a respective bearing bed 5 receiving the respective cylindrical pressing body or roller 41, 42.

Each of the rollers 41, 42 cooperates with a cleaning wiper or scraper S. The rollers 41 and 42 cradle the bearingless working roll 4 which is pressed by the piston 61 and 62 via the pressing rollers 41 and 42 in the directions of arrows C and D so as to have a resultant radial force in the direction of arrow E.

In this embodiment, the force of the pistons 6 is substantially vertical and the force of the pistons 61 is substantially horizontal. The resulting force is thus inclined upwardly at a 45° angle to the horizontal and vertical. This pressing force can be reinforced by actuation of the magnetic force generating device 9. In this case, the working roll 4 may be composed at least partly of magnetic material.

Figure 8:
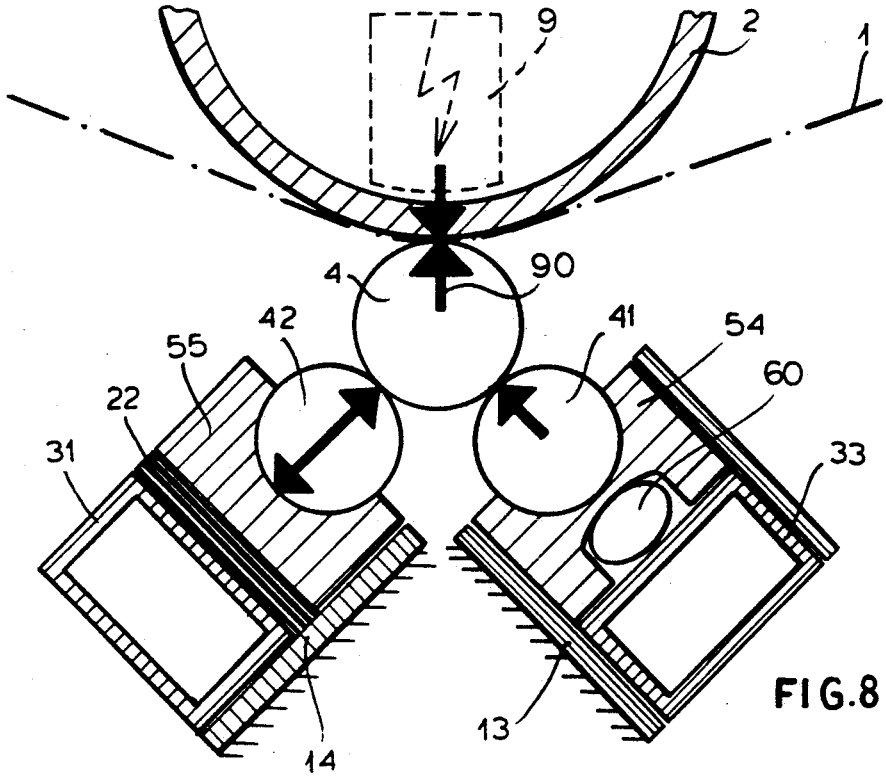
FIG. 8 illustrates an embodiment similar to FIG. 7 also in cross section with the difference that only one of the support bodies or rollers is provided with the force generating means.

FIG. 8 also shows two cylindrical bodies or rollers 41, 42 in respective beds 54, 55, only the bed 54 of the roller 41 of which is provided with a pressing force generator in the form of an expandable tube 60 in the manner previously described. The bed 55 is supported by a deformable cushion 22, e.g. of rubber against the support beam 31 mounted on a plate 14 fixed to the housing 3b. The beam 33 is likewise carried by a plate 13 affixed to the housing. The cylindrical body or roller 42 has only a supporting and counterpressure function.

As can be seen from FIG. 8, the two beams 31 and 33 are braced against fixed supports 13 and 14 which are inclined at 45° to the vertical so that a resultant force in the direction of arrow 90 which is vertical is applied to the working roller 4 in the direction of the counterroller 2 and the web 1. A magnetic force generator can be provided here as well. The support 13 forms a guide for the bed 54 during its pressing movement in the direction of working roll 4.

Figure 9:
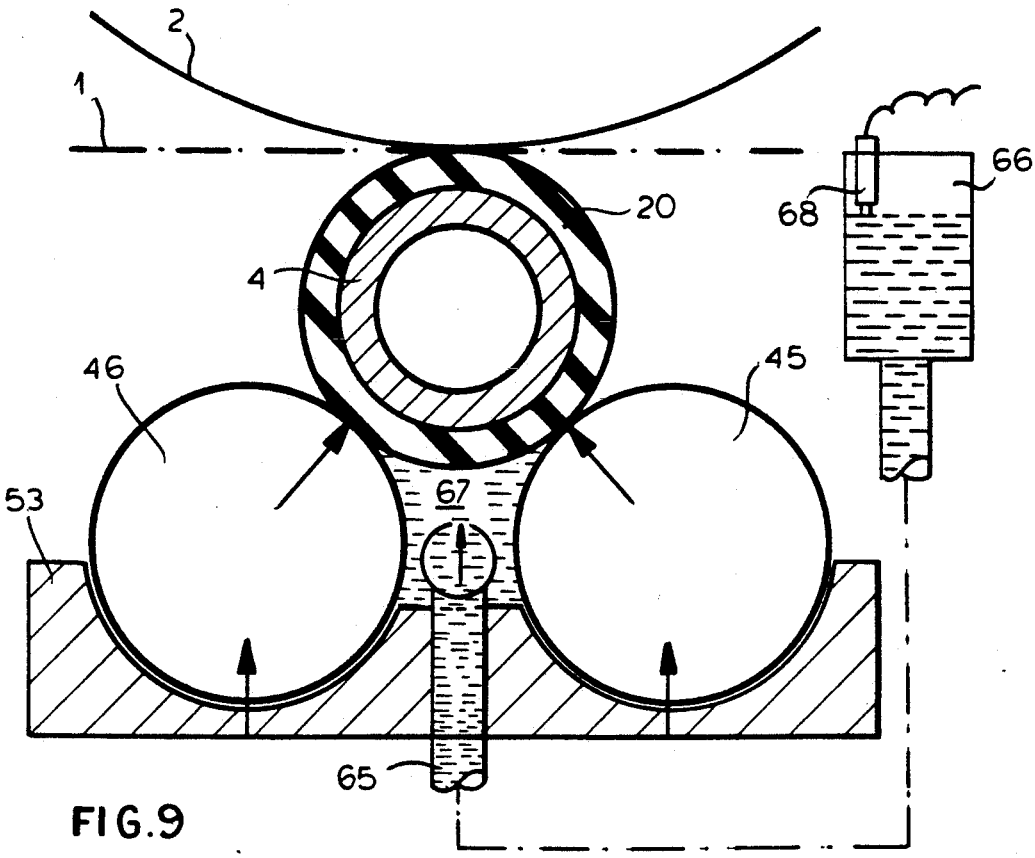
FIG. 9 is a cross sectional view showing the feed of a flowable substance to the working roller of a system like that of FIG. 8.

FIG. 9 shows how a liquid substance can be supplied to the cradle between cylindrical pressing rollers 45 and 46 in the embodiments of FIGS. 1 and 4, for example, in which the rollers are provided in common bendable bearing bed 53. In this case, the space with the rollers 45 and 46 and below the working roller 4 and above the bed 53 shown at 67 is a liquid compartment which is connected via a conduit 65 to a source of the substance, namely, a supply container 66 having a level slightly higher than that of the bed 53 and provided with a level control maintaining the level within the supply vessel 66. The flowable substance passes by gravity into the compartment 67 from which it is transferred to the bibulous jacket 20 of the working roller 4.

I claim:

1. An apparatus for treating a web, comprising:

means forming a countersurface along which said web is guided, said countersurface extending across a width of the web;

an elongated stiff support element spaced from said countersurface, extending over said width and being substantially nonbendable over a length of said support element;

a pressing-force generator on said support element and braced thereby for applying a pressing force generally in a direction of said countersurface; and a bendable assembly interposed between said web and said pressing-force generator and adapted to bend upon the application of said pressing force thereto across said width to conform to said countersurface, said assembly comprising:

a working roll free from axial journals and floating relative to said countersurface juxtaposed with said countersurface and bearing upon said web, and at least one force transmitting member bearing upon said working roll and acted upon by said pressing force generator, extending over a length of said working roll and supporting same while transmitting said pressing force to said working roll, both said working roll and said force transmitting member being bendable over said width.

2. The apparatus defined in claim 1 wherein said countersurface is formed by a drum and said working roll has a substantially smaller diameter than said drum.

3. The apparatus defined in claim 2 wherein said working roll is peripherally supported and driven and is capable of axial movement in the direction of said width.

4. The apparatus defined in claim 2 wherein said working roll is peripherally supported and axially movable and is provided with a friction drive.

5. The apparatus defined in claim 2 wherein said drum is hollow and a magnetic force generator acting upon said working roll is received in said drum.

6. The apparatus defined in claim 1 wherein said working roller is provided with a jacket which is compressible and capable of taking up, transporting and releasing a flowable substance.

7. The apparatus defined in claim 1 wherein said pressing force generator is provided with at least one hydraulic, pneumatic, mechanical or magnetic device for applying said pressing force to said force transmitting member.

8. The apparatus defined in claim 7 wherein a plurality of said devices are spaced apart along said element for applying said pressing force to said member.

9. The apparatus defined in claim 7 wherein said device is a liquid expandable tube received between said member and said element.

10. The apparatus defined in claim 7 wherein said device bears on a plate carrying said member and said working roll.

11. The apparatus defined in claim 10 wherein said plate is swingable along one side of said plate to form a lever and said generator bears selectively on said plate to effect force multiplication, transmission or reduction via said lever.

12. The apparatus defined in claim 10 further comprising a reinforcement received between said generator and said plate at each location at which said generator acts upon said plate.

13. The apparatus defined in claim 1 wherein said force transmitting member is a cylindrical body or roller free from axial journals.

14. The apparatus defined in claim 13 wherein said cylindrical body or roller is received in a bendable bearing bed.

15. The apparatus defined in claim 13 wherein said cylindrical body or roller is preferably driven.

16. The apparatus defined in claim 1 wherein said force transmitting member is a bendable bearing bed having a recess receiving said working roll.

17. The apparatus defined in claim 1 wherein a plurality of web treating stations with respective working rolls are provided along said countersurface.

18. The apparatus defined in claim 1 wherein said countersurface is formed by a drum having a substantially larger diameter than said working roll and said working roll is supported by a cradle formed by two force transmitting rollers each received in a recess of a slide bearing bed, said bed, said rollers and said working roll all being bendable upon the application of said pressing force through said force transmitting rollers and said bed to said working roll.

19. The apparatus defined in claim 18 wherein each of said recesses is provided in a respective bed, one of said beds being hydraulically biased by said generator toward said drum, the other of said drums being supported by a resilient cushion.

* * * * *